US006003183A

United States Patent [19]

Ghering

[11] Patent Number: 6,003,183

[45] Date of Patent: Dec. 21, 1999

[54] MODULAR BRIDGE SECTION

[75] Inventor: Jan Ghering, Ginsheim-Gustavsburg, Germany

[73] Assignee: Man Technologies AG, Augsburg, Germany

[21] Appl. No.: 09/108,697

[22] Filed: Jul. 2, 1998

[30] Foreign Application Priority Data

Jul. 3, 1997 [DE] Germany ..... 197 28 416

[51] Int. Cl.[6] ..... E01D 15/12

[52] U.S. Cl. ..... 14/2.4; 14/74.5

[58] Field of Search ..... 14/2.4, 2.5, 2.6, 14/13, 14, 15, 3, 6, 27, 28, 73, 73.5, 74.5

[56] References Cited

U.S. PATENT DOCUMENTS

| | | | |
|---|---|---|---|
| 3,499,179 | 3/1970 | Weild | 14/27 |
| 3,504,389 | 4/1970 | Longbottom | 14/13 |
| 4,520,523 | 6/1985 | Fitzgerald-Smith et al. | 14/2.4 |
| 4,615,063 | 10/1986 | Rolen | 14/14 |

FOREIGN PATENT DOCUMENTS

WO 93/21390 10/1993 WIPO .

*Primary Examiner*—James A. Lisehora
*Attorney, Agent, or Firm*—McGlew and Tuttle, P.C.

[57] ABSTRACT

A modular bridge section including one or more box girders, wherein at least one box girder 1, 1' is equipped with at least one lower chord structure 5, 5', which is mounted floatingly at or in the box girder 1, 1' in the loaded state only between the end stops 6, 6', 6", 6'", which are arranged in the vicinity of the coupling elements 7, 7, 7", 7'".

14 Claims, 3 Drawing Sheets

MODULAR BRIDGE SECTION

FIELD OF THE INVENTION

The present invention pertains to a modular bridge section for a floating bridge according to the preamble of the principal claim.

BACKGROUND OF THE INVENTION

A bridge section with one detachable lower chord structure each in the area of a side wall of a box girder has been known from WO 93/21390. The arrangement is designed in this way in order for the lower chord structure to be able to be detached in a simple manner from the box girder by pulling out laterally the short horizontal connecting pin.

It is disadvantageous that the lower chord structure is subject not only to tension, but also to bending. In addition, the connecting pins of the lower chord structure are subject to both horizontal and vertical forces. The horizontal forces are generated from the tensile forces, which are introduced into the coupling elements. The vertical forces are generated from the difference in height between the connections at the box girder and the positions of the coupling holes. These vertical forces are superimposed by transverse forces arising from the load on the bridge.

In addition, it must be pointed out that this bridge section has a detachable lower chord structure for a bridge on two supports and also an integrated lower chord structure. When this bridge section is used for a floating bridges, the first-named lower chord structure shall be removed in order to reduce the redundant weight.

SUMMARY AND OBJECTS OF THE INVENTION

The primary object of the present invention is to design a lower chord structure, specially for bridge sections of floating bridges, such that the connections of such a lower chord structure at the box girder are designed optimally.

The lower chord structure shall always remain in the bridge section and shall not be detachable, as in the bridge module according to the above-described state of the art.

The object described is accomplished according to the claims in a lower chord structure of the type described in the introduction by the lower chord structure being mounted floatingly, i.e., flexibly, in the loaded state only between the end stops, which are arranged in the vicinity of the coupling elements.

The advantages achieved by the present invention are mainly that only the difference between the two tensile forces in the lower chord structure are introduced into the box girder via one of the two end stops.

This end stop transmitting the differential force is located at the end of the lower chord structure, namely, at the opposite end, where the stronger tensile force is introduced into the lower chord structure.

Furthermore, provisions are made according to one embodiment of the present invention for the end stop to be arranged vertically, to be able to be designed as a cylindrical bolt, or to have a square shaft with two round pins, and for it to be preferably mounted in both blind holes in the box girder and in a clamp, wherein the clamp is rigidly connected to the box girder.

It is achieved as a result that 1. the lower chord structure is not subject to bending, because the force is transmitted in the end stops via a double-shear connection;
2. no water can enter the interior of the box girder via a bolt clearance and pin clearance that may have developed when the bridge section is used in a floating bridge, and
3. the clamps have not only a load transmission function, but they also secure the cylindrical end stop against falling out at the same time.

It is preferably also provided according to the present invention that the broad side of the rectangular beam tie is arranged in the plane of the bottom of the box girder.

The present invention offers a possibility of designing the bottom of the box girder such that the tensile forces introduced by the vertical end stops are locally transmitted in the area of the coupling elements only in the case of the arrangement of a lower chord structure between the longitudinal side walls. These tensile forces are weaker than the maximally occurring tensile forces in the lower chord structure. The rest of the area of the box girder bottom now has only the task of keeping the box girder water-tight when it is used as a floating bridge section and no additional fillings are arranged in the interior of the box girder.

The use of the modular bridge section according to the present invention is not limited to the use in floating bridges. It may, of course, also be used for bridges on supports while maintaining the features according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
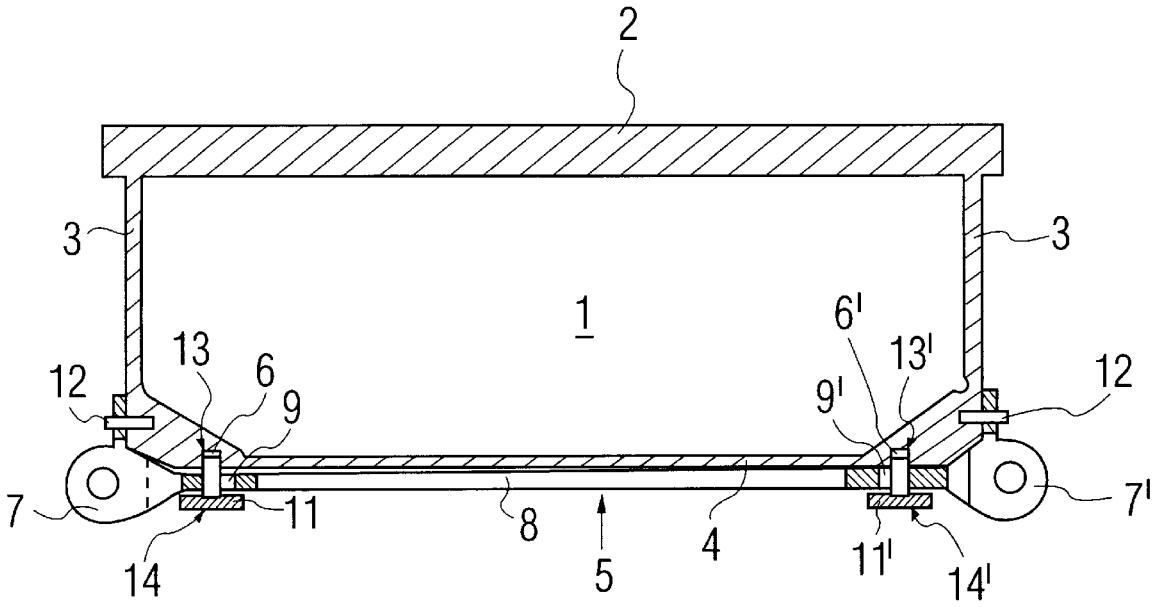
FIG. 1 is a view of a longitudinal section of a box girder with cylindrical end stops for the lower chord structure.

Referring to the drawings, FIG. 1 shows a vertical longitudinal section of a box girder 1 with a deck 2 that is load-bearing for vehicular travel, with side walls 3 and with a lower chord structure 5 under the bottom 4 of the box girder 1. The chord structure having means in the material of the chord structure for transmitting tensile forces.

Cylindrical end stops 6, 6' are arranged in the vicinity of the coupling elements 7, 7' of the lower chord structure 5. The rectangular beam tie 8, which connects the coupling elements 7, 7' to one another, has one or more elongated holes 9, 9' in the area of the coupling elements 7, 7'. A cylindrical end stop 6, 6' is passed through each elongated hole 9, 9'. The end stops 6, 6' are mounted in the box girder 1 and in a clamp 11, 11' fastened to the box girder 1, preferably in blind holes 13, 13' in the box girder 1 and in holes 14, 14' in the clamp 11, 11'. It is achieved as a result that no bending moments develop in the lower chord structure 5 due to the double-shear connection and the wall of the hole in the connection structure is kept low.

The blind holes 13, 13' have a larger diameter than the hole 14, 14' in the clamp 11, 11'. The cylindrical stop 6, 6' is mounted captively as a result.

An intended clearance between the box girder 1 and the clamps 11, 11', which makes possible a free longitudinal movement of the rectangular beam tie 8 in the loaded state, is recognizable.

To make possible a horizontal displacement of the coupling elements 7, 7', which is equal to the elongation of the beam tie 8, the horizontal bolts 12, 12' are arranged above the coupling elements 7, 7' in the longitudinal direction of the beam tie 8. The bolts 12, stops 6, holes 13 and clamps 11 form a mounting means for creating a floating or sliding connection between the chord structure and the box girder in a loaded state of the chord structure. The mounting means transmits a difference in tensile forces at ends of said chord to the box girder.

Figure 2:
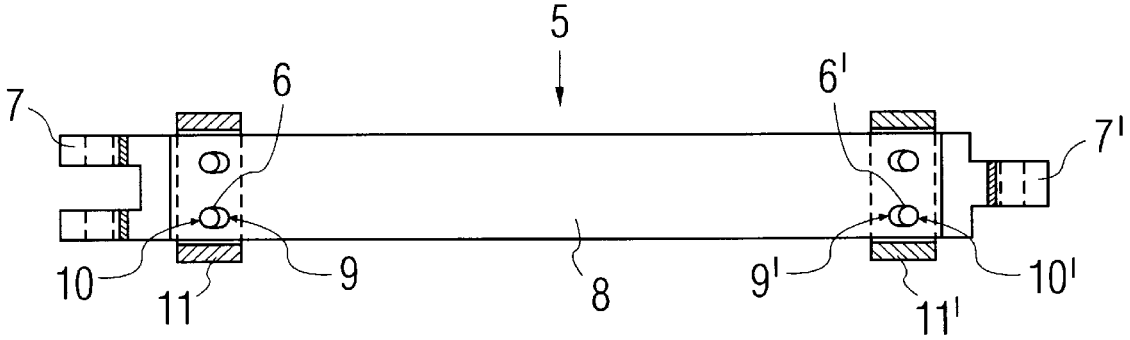
FIG. 2 is a horizontal view along the box girder bottom on the lower chord structure according to FIG. 1.

FIG. 2 shows a horizontal view along the box girder bottom 4 on the lower chord structure 5 in the unloaded state. It can be recognized how the cylindrical end stops 6, 6' are now in contact with the inner surfaces 10, 10' of the elongated holes 9, 9'. The elongated holes 9, 9' are at least as long as the maximum elongation of the beam tie 8 at the maximally occurring tensile force in the lower chord structure 5.

Figure 3:
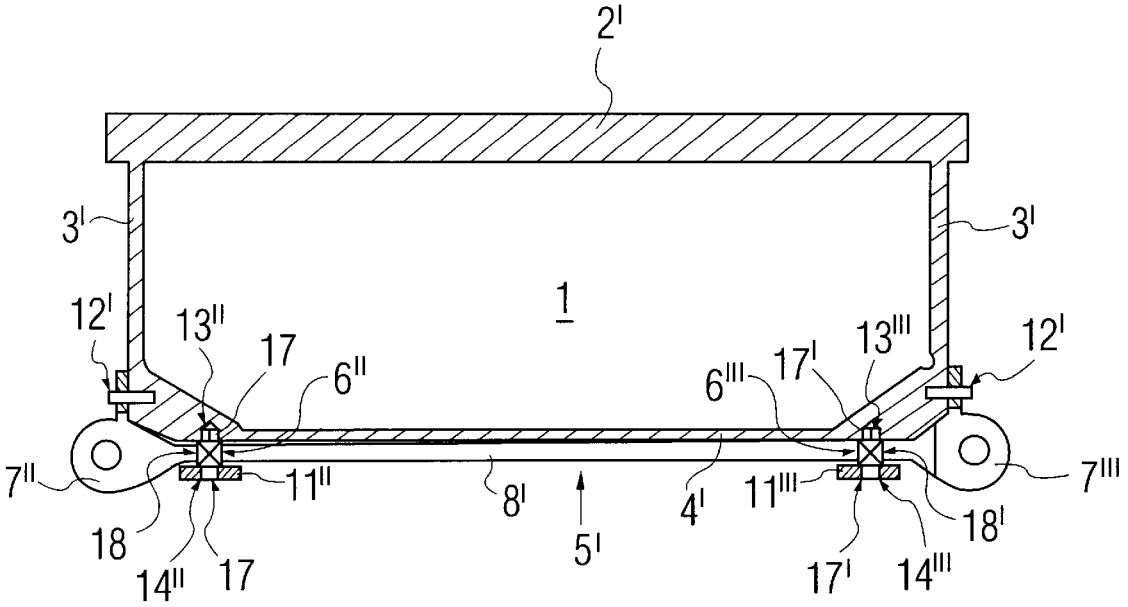
FIG. 3 is a longitudinal sectional view of a box girder with square, shaft-like stops for the lower chord structure.

FIG. 3 shows a vertical longitudinal section of a box girder 1' with a deck 2' that is load-bearing for vehicular travel, with side walls 3' and with a lower chord structure 5' under the bottom 4' of the box girder 1'.

End stops 6", 6'" are arranged at the transition point 15, 15' between the coupling element 7", 7'" and the beam tie 8' in the vicinity of the coupling elements 7", 7'" of the lower chord structure 5'.

The broad side $B_z$ of the preferably rectangular beam tie 8' is smaller than the broad side $B_k$ of the coupling elements 7", 7'". In the unloaded state of the lower chord structure 5', the projecting surfaces 18, 18' of the two coupling elements 7", 7'" are in contact with the square shafts 16 of the end stops 6", 6'", which shafts are located on both sides of the beam tie 8'. Each square shaft 16 has two round pins 17, 17', which are mounted in the box girder 1' as well as in a clamp 11", 11'" connected to the box girder 1'. The advantage of this mounting of the pins is that the end stops 6", 6'" are always in contact with the projecting surfaces 18, 18' and thus they generate weak contact pressures.

The round pins 17 of the end stops 6", 6'" are mounted in respective blind holes 13", 13'" of the box girder 1', and the round pins 17 are mounted in holes 14", 14'" of the clamps 11", 11'". The end stop 6", 6'" is secured against falling out by the square shaft 16.

An intended clearance between the box girder 1' and the clamps 11", 11'", which makes possible a free longitudinal movement of the rectangular beam tie 8' in the loaded state, is clearly recognizable.

Horizontal displacement of the coupling elements 7", 7'", which is equal to the elongation of the beam tie 8', is possible due to the arrangement of the horizontal bolts 12", 12'" above the coupling elements 7", 7'" in the longitudinal direction of the beam tie 8'.

Figure 4:
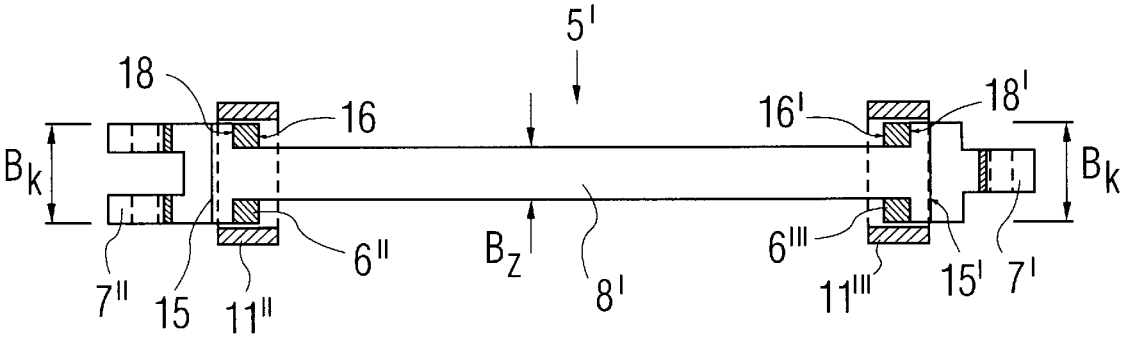
FIG. 4 is a horizontal view along the box girder bottom on the lower chord structure according to FIG. 3.
Figure 5:
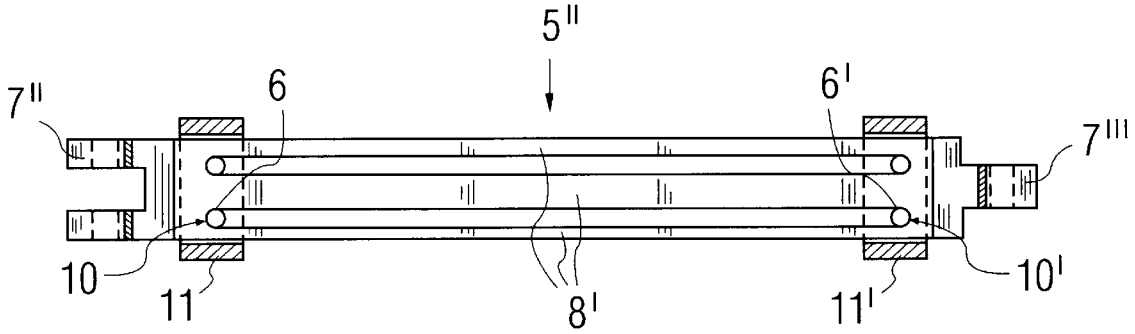

FIG. 4 shows a horizontal view along the box girder bottom 4' on the lower chord structure 5' in the unloaded state. It can be recognized that each of the two end stops 6", 6'" arranged on both sides of the beam tie 8' is arranged in the immediate vicinity of the transition point 15, 15' of the coupling element 7", 7'" with the beam tie 8'.

The two projecting surfaces 18, 18' of the coupling element 7, 7' are in contact with the square shafts 16, 16' of the end stops 6", 6'" in the unloaded state of the lower chord structure 5'.

While specific embodiments of the invention have been shown and described in detail to illustrate the application of the principles of the invention, it will be understood that the invention may be embodied otherwise without departing from such principles.

What is claimed is:

1. A modular bridge section comprising:

a box girder;

a chord structure arranged on one side of said box girder for transmitting tensile forces occurring at said one side of said box girder, said chord structure including opposite ends with a first end of said chord structure including a fork- and an eye-shaped coupling element and a second end of said chord structure including another fork- and an eye-shaped coupling element with a beam tie in between said coupling elements; and mounting means for forming a floating connection between said chord structure and said box girder in a loaded state of said chord structure, said mounting means including coupling holes provided in a plane of coupling holes and a bolt arranged substantially in parallel with said one side of said box girder and above said plane of coupling holes, said bolt being arranged adjacent to said first end of said chord structure, said mounting means including a plurality of end stops arranged adjacent to said coupling elements allowing sliding movement between said chord structure and said box girder.

2. A modular bridge section in accordance with claim 1, wherein:

said mounting means includes a clamp;

said end stops have a cylindrical shape and are mounted substantially perpendicular to said one side of said box girder, said end stops are positioned in said box girder and in said clamp;

said beam tie defines a plurality of elongated holes and said end stops are positioned in said elongated holes, each of said elongated holes have an inner surface adjacent said ends, said elongated holes are positioned with respect to said end stops to have said inner surface of said elongated holes contact said end stops during an unloaded state of said chord structure, said elongated holes have a length substantially equal to or greater than a maximum elongation of said beam tie under maximally occurring tensile force in said lower chord structure;

said bolt is arranged above said coupling elements in a longitudinal direction of said beam tie, said bolts having means for horizontal displacement of said chord structure, said horizontal displacement being substantially equal to slid elongation of said beam tie.

3. A modular bridge section in accordance with claim 1, wherein:

said chord structure includes transition points between said coupling elements and said beam tie, said end stops are positioned at said transition points, said beam tie and said coupling elements having a broad side, said broad side of said beam tie being smaller than said broad side of said coupling element at said transition point;

said mounting means includes a clamp;

said coupling elements include projecting surfaces;

two of said plurality of end stops being positioned at one said end of said beam tie on opposite sides of said beam tie, each of said end stops have a square shaft with two round pins, said round pins being mounted in said box girder and said clamp, said end stops being in contact with said projecting surfaces during an unloaded state of said chord structure.

4. A modular bridge section in accordance with claim 1, wherein:

said mounting means includes a clamp;

said box girder includes blind holes, said end stops are mounted in said blind holes;

said clamp defines a plurality of holes, said end stops are mounted in said holes of said clamp;

said mounting means holds said chord structure freely movable with respect to said box girder in a longitudinal direction of said chord structure during a loaded state of said chord structure;

said beam tie has a broad side, said broad side of said beam tie being in a plane of said one side of said box girder, and said beam tie includes a plurality of braces connecting said coupling elements, said end stops being positioned between said plurality of braces.

5. A modular bridge according to claim 1, wherein said mounting means includes elongated holes formed in said beam tie and bolts connecting said chord structure to said beam tie and extending through said elongated holes.

6. A modular bridge according to claim 1, wherein said mounting means includes holes in said coupling element, respectively slidingly receiving said bolt and another bolt.

7. A modular bridge section comprising:

a box girder;

a chord structure arranged on one side of said box girder, and having means for transmitting tensile forces occurring in said one side of said box girder, said chord structure including opposite ends; and mounting means for forming a sliding connection between said chord structure and said box girder in a loaded state of said chord structure, said mounting means transmitting a difference in tensile forces at said ends of said chord to said box girder.

8. A modular bridge section in accordance with claim 7 wherein:

said ends of said chord structure include fork- and eye-shaped coupling elements, said chord structure includes a beam tie connecting said coupling elements;

said mounting means includes a bolt arranged substantially parallel with said one side of said box girder, said bolt being arranged adjacent one end of said chord structure, said mounting means including end stops arranged adjacent said coupling elements.

9. A modular bridge section comprising:

a box girder having a bottom;

a chord structure arranged on one side of said box girder, said chord structure including coupling elements and a beam tie disposed between the coupling elements and connecting the coupling elements for transmitting tensile forces occurring at sides of said box girder, said coupling elements including coupling holes; and a floating connection between said chord structure and said box girder in a loaded state of said chord structure, said floating connection including a bolt arranged substantially parallel with said bottom of said box girder and above said coupling holes and end stops arranged adjacent to said coupling elements, respectively between said chord structure and said box girder to allow flexible movement between said chord structure and said box girder.

10. A modular bridge section in accordance with claim 9, wherein said floating connection includes a clamp;

said end stops have a cylindrical shape and are mounted substantially perpendicular to a respective side of said box girder, said end stops being positioned in said box girder and in said clamp;

said beam tie defines a plurality of elongated holes and said end stops are positioned in said elongated holes, each of said elongated holes having an inner surface adjacent said ends, said elongated holes being positioned with respect to said end stops to have said inner surface of said elongated holes contact said end stops in an unloaded state of said chord structure, said elongated holes having a length substantially equal to or greater than a maximum elongation of said beam tie under maximally occurring tensile force in a lower part of said chord structure; and said bolts are arranged above said coupling elements in a longitudinal direction of said beam tie, said bolts being connected to allow for horizontal displacement of said chord structure, said horizontal displacement being substantially equal to said elongation of said beam tie.

11. A modular bridge section in accordance with claim 9, wherein:

said chord structure includes transition points between said coupling elements and said beam tie, said end stops are positioned adjacent to said transition points, said beam tie and said coupling elements having a broad side, said broad side of said beam tie being smaller than said broad side of said coupling element at said transition point;

said floating connection includes a clamp;

said coupling elements include projecting surfaces; and two of said end stops being positioned at one said end of said beam tie on opposite sides of said beam tie, each of said end stops having a square shaft with two round pins, said round pins being mounted in said box girder and said clamp, said end stops being in contact with said projecting surfaces during an unloaded state of said chord structure.

12. A modular bridge section in accordance with claim 11, wherein:

said mounting means includes a clamp;

said box girder includes blind holes, said end stops are mounted in said blind holes;

said clamp defines a plurality of holes, said end stops are mounted in said holes of said clamp;

said mounting means holds said chord structure freely movable with respect to said box girder in a longitudinal direction of said chord structure during a loaded state of said chord structure; and said broad side of said beam tie is in a plane of said one side of said box girder, and said beam tie includes a plurality of braces connecting said coupling elements, said end stops are positioned between said plurality of braces.

13. A modular bridge according to claim 9, wherein said mounting means includes elongated holes formed in said beam tie and bolts connecting said chord structure to said beam tie and extending through said elongated holes.

14. A modular bridge according to claim 9, wherein said mounting means includes holes in said coupling element, respectively slidingly receiving said bolt and another bolt.

* * * * *